US006979029B2

(12) United States Patent
Shen

(10) Patent No.: US 6,979,029 B2
(45) Date of Patent: Dec. 27, 2005

(54) LOCK WITH INCREASED TORQUE-RESISTING CAPACITY

(76) Inventor: Mu-Lin Shen, No. 18, Industry 3 Rd., An-Nan District, Tainan (TW)

( * ) Notice: Subject to any disclaimer, the term of this patent is extended or adjusted under 35 U.S.C. 154(b) by 36 days.

(21) Appl. No.: 10/732,716

(22) Filed: Dec. 10, 2003

(65) Prior Publication Data

US 2005/0127691 A1 Jun. 16, 2005

(51) Int. Cl.[7] ..... E05B 3/00

(52) U.S. Cl. ..... 292/336.3; 292/336.5; 292/348; 292/352; 292/357; 70/224

(58) Field of Search ..... 292/336.3, 336.5, 292/348, 352, 357, DIG. 30, DIG. 53, DIG. 54, 292/DIG. 64; 70/224

(56) References Cited

U.S. PATENT DOCUMENTS

| | | | | |
|---|---|---|---|---|
| 235,983 | A | 12/1880 | Batt | |
| 264,575 | A | 9/1882 | Simon | |
| 509,194 | A | 11/1893 | Carty | |
| 576,028 | A | 1/1897 | Churchill | |
| 604,951 | A | 5/1898 | Anderson et al. | |
| 655,605 | A | 8/1900 | Churchill | |
| 1,143,610 | A | 6/1915 | Carr | |
| 1,779,438 | A | 10/1930 | Lowe | |
| 1,899,686 | A | 2/1933 | Herst | |
| 1,899,996 | A | 3/1933 | Sullivan | |
| 2,059,678 | A | 11/1936 | Brigges | |
| 2,497,328 | A | 2/1950 | Smith et al. | |
| 2,529,230 | A | 11/1950 | Smith et al. | |
| 2,615,745 | A * | 10/1952 | Young | 292/348 |
| 2,707,649 | A * | 5/1955 | Young | 292/348 |
| 2,795,948 | A | 6/1957 | Ravburn | |
| 2,998,274 | A | 8/1961 | Russell | |
| 3,308,641 | A | 3/1967 | Russell et al. | |
| 3,550,411 | A | 12/1970 | Neary | |
| 3,713,311 | A | 1/1973 | Oliver et al. | |
| 3,869,890 | A | 3/1975 | Neary | |
| 3,894,417 | A | 7/1975 | Taniyauna | |
| 3,910,612 | A | 10/1975 | Nolin | |
| 3,985,008 | A | 10/1976 | Hart | |
| 3,999,789 | A | 12/1976 | Maurits et al. | |
| 4,129,019 | A | 12/1978 | Urdal | |
| 4,418,552 | A | 12/1983 | Nolin | |
| 4,424,691 | A | 1/1984 | Foshee | |

(Continued)

FOREIGN PATENT DOCUMENTS

| | | |
|---|---|---|
| DE | 1808633 | 6/1970 |

(Continued)

*Primary Examiner*—Brian E. Glessner
*Assistant Examiner*—Carlos Lugo
(74) *Attorney, Agent, or Firm*—Alan D. Kamrath; Nikolai & Mersereau, P.A.

(57) ABSTRACT

A lock includes a main body having an outside seat and an inside seat around which an inside rose liner is mounted. A peripheral wall delimiting a central hole of the inside rose liner includes at least one pair of notches. A reinforcing ring is mounted round the inside seat and inside the inside rose liner. The reinforcing ring includes two tabs each having a distal end received in a respective groove of the inside seat, preventing relative rotation between the reinforcing ring and the main body. Two positioning posts extend from an outside rose liner mounted around the outside seat. Two fasteners extend through the reinforcing ring and the inside rose liner into screw holes of the positioning posts, thereby securing the reinforcing ring, the inside rose liner, and the outside rose liner together. The torque-resisting capacity is thus improved.

5 Claims, 4 Drawing Sheets

U.S. PATENT DOCUMENTS 4,435,967 A 3/1984 Best et al.
4,444,034 A 4/1984 Best et al.
4,604,879 A * 8/1986 Neary et al. ..... 70/224
4,736,970 A 4/1988 McGourty et al.
4,838,053 A 6/1989 Shen
4,869,083 A 9/1989 DeMarseilles et al.
4,884,835 A 12/1989 Smallegan et al.
4,921,289 A 5/1990 Shen
4,930,822 A * 6/1990 Shen ..... 292/357
4,953,373 A 9/1990 Toledano
4,979,767 A 12/1990 Lin
4,995,249 A 2/1991 Preissler et al.
5,018,375 A 5/1991 Tully
5,121,619 A 6/1992 Martin
5,157,952 A * 10/1992 Lin ..... 70/216
5,157,953 A 10/1992 Hung
5,177,987 A 1/1993 Shen
5,233,851 A 8/1993 Florian
5,265,924 A 11/1993 Kim
5,284,372 A 2/1994 Lin
5,301,526 A 4/1994 Fann et al.
5,385,374 A 1/1995 Fann et al.
5,398,531 A 3/1995 Shen
5,447,047 A 9/1995 Lin
5,507,163 A 4/1996 Juang
5,564,296 A 10/1996 Theriault et al.
5,590,555 A 1/1997 Kester et al.
5,598,726 A 2/1997 Cordle
5,605,064 A 2/1997 Katayama et al.
5,617,749 A 4/1997 Park
5,657,653 A 8/1997 Hensley et al.
5,694,798 A 12/1997 Nunez et al.
5,713,231 A 2/1998 Shen
5,727,406 A * 3/1998 Banducci ..... 70/224
5,732,578 A 3/1998 Kang
5,752,399 A 5/1998 Shen
5,761,936 A 6/1998 Katayama et al.
5,768,926 A 6/1998 Shen
5,813,260 A 9/1998 Widen
5,816,086 A 10/1998 Russell et al.
5,845,522 A 12/1998 Shen
5,868,018 A 2/1999 Kang
5,873,272 A 2/1999 Thompson
5,881,585 A 3/1999 Kang
5,881,586 A 3/1999 Shen
5,904,232 A 5/1999 Shen
5,927,777 A 7/1999 Kuo et al.
5,941,108 A 8/1999 Shen
5,960,656 A 10/1999 Yao
5,970,760 A 10/1999 Shen
5,983,683 A 11/1999 Shen
6,014,877 A 1/2000 Shen
6,014,878 A 1/2000 Shen
6,038,896 A 3/2000 Chamberlain et al.
6,041,630 A 3/2000 Shen
6,101,856 A 8/2000 Pelletier et al.
6,109,080 A 8/2000 Chen et al.
6,112,565 A 9/2000 Aramburu
6,151,934 A 11/2000 Chong et al.
6,170,305 B1 1/2001 Shen
6,189,351 B1 2/2001 Eagan et al.
6,279,360 B1 8/2001 Shen
6,302,457 B1 10/2001 Shen
6,360,570 B1 3/2002 Shen
6,364,383 B1 4/2002 Shen
6,412,318 B1 7/2002 Shen
6,425,613 B1 7/2002 Shen
6,532,779 B2 3/2003 Shen
6,735,993 B2 * 5/2004 Eller et al. ..... 70/224
6,860,129 B2 * 3/2005 Eller et al. ..... 70/217

FOREIGN PATENT DOCUMENTS

DE 2723887 12/1978
GB 537277 6/1941
GB 555550 8/1943
NO 35783 9/1922

* cited by examiner

LOCK WITH INCREASED TORQUE-RESISTING CAPACITY

BACKGROUND OF THE INVENTION

1. Field of the Invention

The present invention relates to an inside rose liner for a lock. In particular, the present invention relates to a lock with improved torque-resistant capacity.

2. Description of the Related Art

A typical door lock includes a main body having an inside seat and an outside seat, an inside rose liner securely mounted to the inside seat, an outside rose liner securely mounted to the outside seat, an inside rose, an outside rose, an inside handle, and an outside handle. The inside handle and the outside handle of lever type are convenient to the disabled. The inside seat includes two diametrically disposed grooves, and the inside rose liner includes two diametrically disposed protrusions respectively engaged in the grooves of the inside seat. Similar design is adopted in the outside seat and the outside rose liner. The door lock of such a structure is simple and has a low manufacture cost. Nevertheless, the torque resulting from the force applied to the lever type handle for opening the door is relatively greater than that of a knob type handle. The simple engagement of the grooves and protrusions between the respective rose liner and the respective seat is insufficient to resist the torque if lever type handles are used. As a result, the inner parts of the door lock using lever type handles are apt to be damaged.

U.S. Pat. No. 6,364,383 discloses an easy-to-install door lock with burglar-proof effect for the outside rose assembly, wherein each of the inside seat and the outside seat of the main body of the door lock includes two diametrically disposed flat surfaces. Further, the inside rose liner includes a threaded inner periphery for threadedly engaging with an outer threading of the inside seat. An anti-torque ring is engaged on the outside seat for improving the torque-bearing capacity. The anti-torque ring includes a central hole having two diametrically disposed flat sections, allowing the anti-torque ring to be mounted around the outside seat without the risk of relative rotation and providing improved burglar-proof effect. An adjusting sleeve is threadedly engaged with the outside seat, with an end of the adjusting sleeve being securely engaged with a central stepped portion of the outside rose, and with the other end of the adjusting sleeve abutting against the anti-torque ring to thereby retain the anti-torque ring in place.

However, the adjusting sleeve of the door lock disclosed in U.S. Pat. No. 6,364,383 has to be cylindrical, and the outside rose must be processed to form the central stepped portion for receiving the end of the cylindrical adjusting sleeve. The design flexibility of the outside rose is limited. Further, it is difficult to provide the cylindrical adjusting sleeve with high strength. Thus, the strength of the whole lock structure is limited.

SUMMARY OF THE INVENTION

An object of the present invention is to provide a lock with increased torque-resistant capacity while allowing design flexibility of an outside rose of the lock.

In accordance with an aspect of the present invention, a lock includes a main body having an inside seat and an outside seat. An inside rose liner is mounted around the inside seat and includes a central hole. A peripheral wall delimiting the central hole of the inside rose liner includes at least one pair of notches. A reinforcing ring is mounted around the inside seat and inside the inside rose liner. The reinforcing ring includes two tabs each having a distal end received in a respective groove of the inside seat, preventing relative rotation between the reinforcing ring and the main body. An outside rose liner is mounted around the outside seat. Two positioning posts extend from an inner side of the outside rose liner, with each positioning post having a screw hole. Two fasteners extend through the reinforcing ring and the inside rose liner into the screw holes of the positioning posts, thereby securing the reinforcing ring, the inside rose liner, and the outside rose liner together. The torque-resisting capacity is thus improved.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
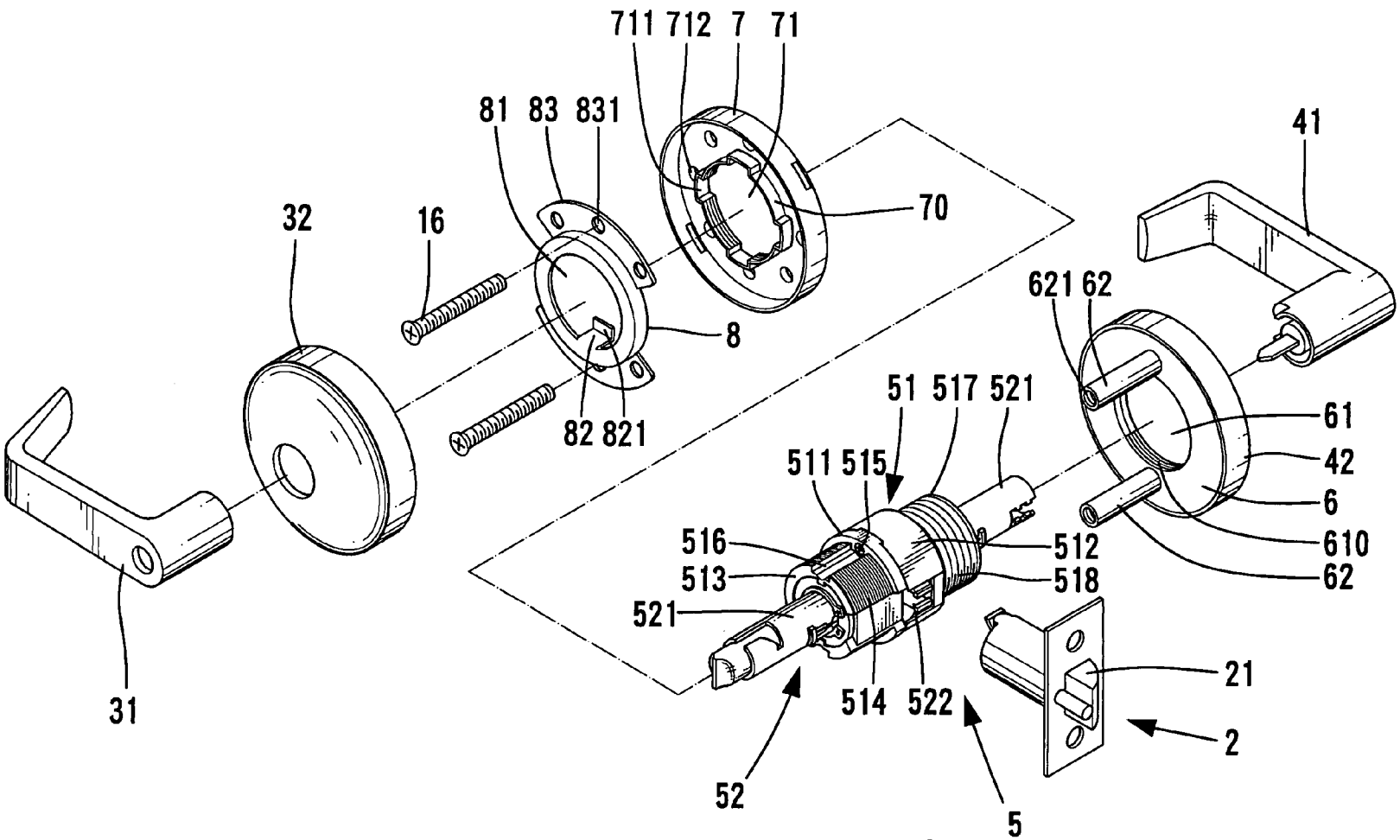
FIG. 1 is an exploded perspective view of a lock in accordance with the present invention.
Figure 2:
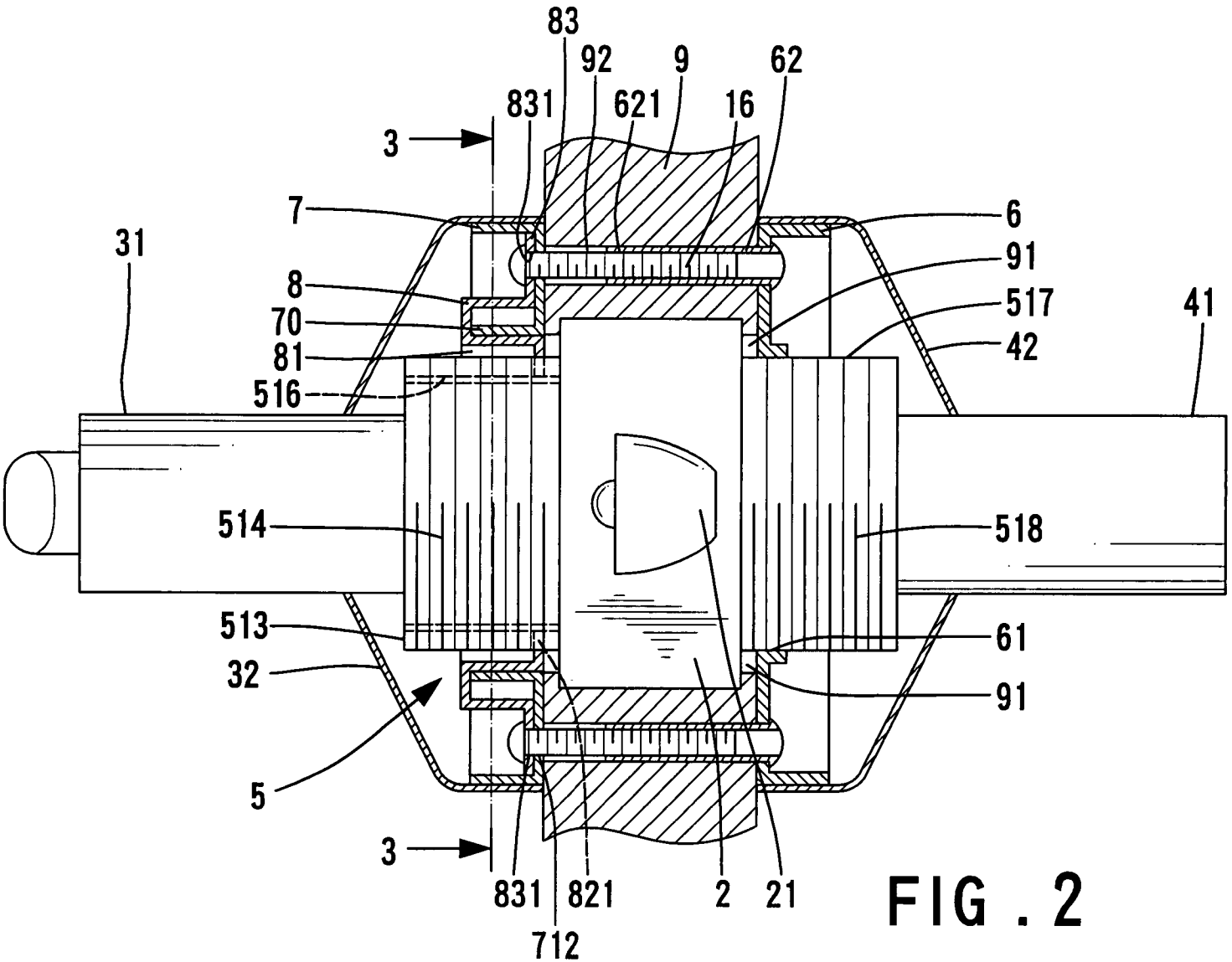
FIG. 2 is a sectional view of a door and the lock in accordance with the present invention mounted to the door.
Figure 3:
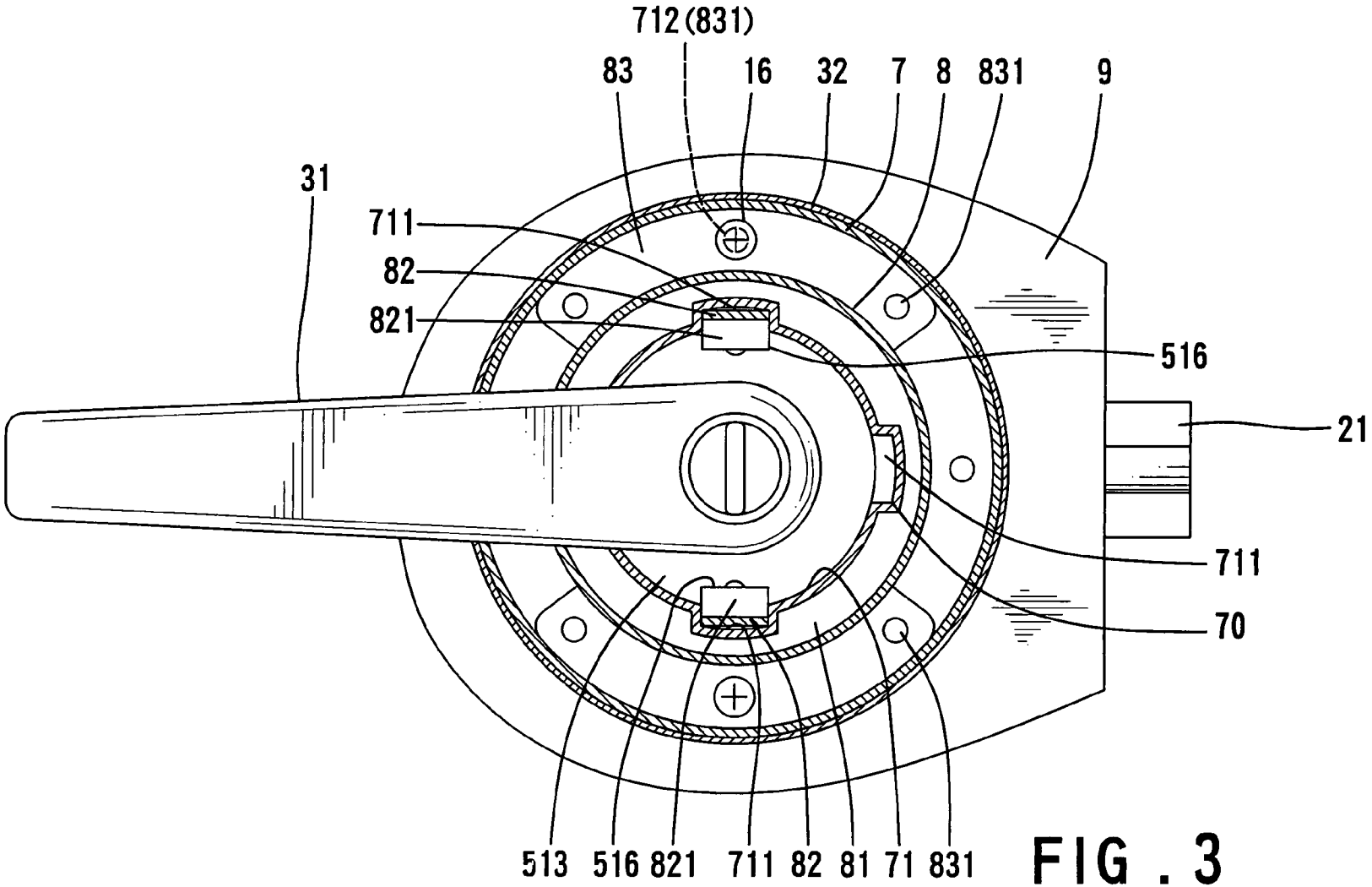
FIG. 3 is a sectional view taken along line 3-3 in FIG. 2.

Referring to FIGS. 1 through 3, a lock 5 in accordance with the present invention generally comprises a main body 51 to be mounted in a borehole 91 of a door 9. The lock further includes an inside rose 32, an outside rose 42, an inside handle 31, and an outside handle 41. The inside handle 31 and the outside handle 41 are of lever type, which is convenient to the disabled.

The main body 51 includes an inside seat 511 and an outside seat 512. The inside seat 511 includes a threaded section 513 having an outer threading 514. The outside seat 512 includes a threaded section 517 having an outer threading 518. A transmission assembly 52 is mounted inside the main body 51 and includes a spindle 521 and a retractor 522 operably connected to the spindle 521. Two ends of the spindle 521 are respectively connected to the inside handle 31 and the outside handle 41. Turning of either handle 31, 41 causes movement of the retractor 522, which, in turn, causes retraction of a latch bolt 21 of a latch assembly 2, which is conventional, Of course, the spindle 521 may consist of two sections respectively attached to the inside handle 31 and the outside handle 41.

The inside seat 511 includes two diametrically disposed screw holes (not shown), with two screws 515 extending through the screw holes of the inside seat 511 into screw holes (not shown) in the outside seat 512, thereby securely connecting the inside seat 511 and the outside seat 512 together. Further, the threaded section 513 of the inside seat 511 includes two diametrically disposed grooves 516A, respectively, aligned with the screw holes of the inside seat 511, allowing easy mounting of the screws 515.

An outside rose liner 6 is mounted inside the outside rose 42 and around the outside seat 512. The outside rose liner 6 includes a central hole 61 having an inner threading 610 for threadedly engaging with the outer threading 518 of the outside seat 512. Two positioning posts 62 extend from an inner side of the outside rose liner 6 and extend through two positioning holes 92 in the door 9.

The inside rose liner 7 is mounted inside the inside rose 32 and around the inside seat 511. The inside rose liner 7 includes a central hole 71 threadedly engaged with the outer threading 514 of the inside seat 511. A peripheral wall 70 delimiting the central hole 71 includes a plurality of pairs of notches 711. One of the pairs of notches 711 is selectively aligned with the grooves 516 of the threaded section 513. Further, the inside rose liner 7 includes a plurality of pairs of through-holes 712, with one of the plurality of pairs of through-holes 712 being selectively aligned with the screw holes 621 of the positioning posts 62.

Figure 4:
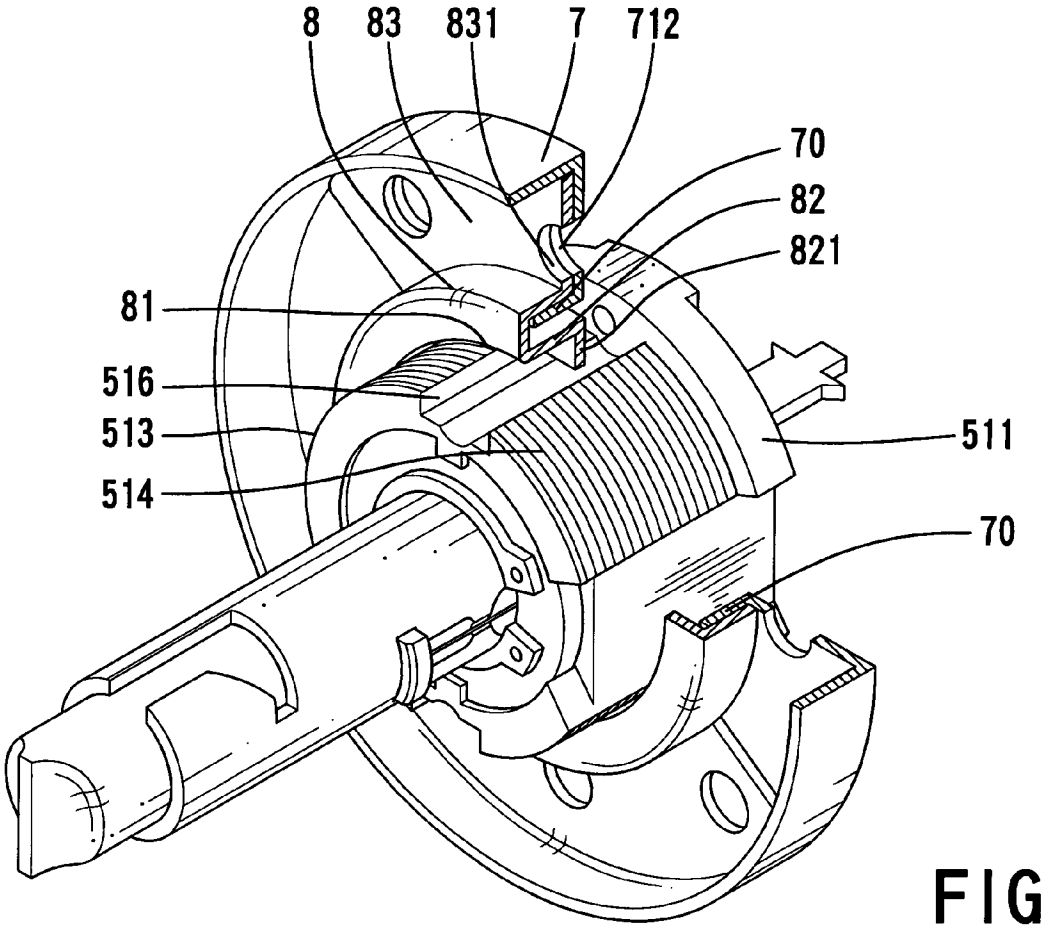
FIG. 4 is a perspective view, partly cutaway, illustrating an outside rose liner and a reinforcing ring mounted to an outside seat of the lock in accordance with the present invention.

A reinforcing ring 8 is mounted inside the inside rose liner 7. As illustrated in FIGS. 1 and 4, the reinforcing ring 8 includes a central hole 81 through which the threaded section 513 of the inside seat 511 extends. Two diametrically disposed tabs 82 project from a periphery delimiting the central hole 81 of the reinforcing ring 8 and extending along a direction parallel to a longitudinal axis of the reinforcing ring 8, with an end piece 821 being formed on a distal end of the respective tab 82 and extending along a direction orthogonal to the longitudinal axis of the reinforcing ring 8. Further, two diametrically disposed extensions 83 project radially outward from an outer periphery of the reinforcing ring 8, with each extension 83 having a plurality of holes 831.

In assembly, as illustrated in FIGS. 2 and 3, the relative position of the outside rose liner 6 on the threaded section 517 of the main body 51 is adjusted until the retractor 522 is aligned with the latch bolt 21. Namely, the lock in accordance with the present invention can be used with doors having different thicknesses. Next, the positioning posts 62 are aligned with the positioning holes 92 of the door 9, and the main body 51 is inserted into the borehole 91 of the door 9. Next, the inside rose liner 7 is mounted around the threaded section 513 of the inside seat 511, with a pair of notches 711 being aligned with the grooves 516 of the threaded section 513. Then, the reinforcing ring 8 is mounted inside the inside rose liner 7, with the respective tab 82 of the reinforcing ring 8 extending through an associated notch 711 of the inside rose liner 7, and with the end piece 821 being received in the respective groove 516 of the threaded section 513. Preferably, the end piece 821 of the respective tab 82 of the reinforcing ring 8 has a width substantially equal to that of the respective groove 516 of the inside seat 511. Two fasteners (such as screws 16) are then extended through the associated holes 831 of the extensions 83 and the associated through-holes 712 of the inside rose liner 7 into the screw holes 621 of the positioning posts 62, thereby fixing the main body 51 to the door 9.

The inside rose liner 7 and the outside rose liner 6 are adjustably mounted on the inside seat 511 and the outside seat 512, respectively, allowing the lock in accordance with the present invention to be used with doors of different thicknesses. The reinforcing ring 8 cannot be turned relative to the main body 51, as the end piece 821 of the respective tab 82 of the reinforcing ring 8 is received in the respective groove 516 of the threaded section 513. The torque-resisting capacity is increased. Further, since the inside rose liner 7, the outside rose liner 6, and the reinforcing ring 8 are fixed together to securely fix the main body 51 to the door 9, the overall strength of the lock in accordance with the present invention is improved, and the engagement between the main body 51 and the door 9 is more reliable. Further, the inside rose 32 and the outside rose 42 require no processing, providing design flexibility for the inside rose 32 and the outside rose 42; namely, the inside rose 32 and the outside rose 42 can be of any desired shapes, while the inside rose liner 7 and the reinforcing ring 8 provide the lock with improved strength and increased torque-resisting capacity.

Although the invention has been explained in relation to its preferred embodiment, it is to be understood that many other possible modifications and variations can be made without departing from the scope of the invention as hereinafter claimed.

What is claimed is:

1. A lock comprising:

a main body including an inside seat and an outside seat, the inside seat including two grooves;

an inside rose liner mounted around the inside seat, the inside rose liner including a central hole, a peripheral wall delimiting the central hole of the inside rose liner including at least one pair of notches;

a reinforcing ring mounted around the inside seat and inside the inside rose liner, the reinforcing ring including two tabs each having a distal end received in the respective groove of the inside seat, preventing relative rotation between the reinforcing ring and the main body, the tabs of the reinforcing ring respectively extending through said at least one pair of notches of the inside rose liner;

an outside rose liner mounted around the outside seat, two positioning posts extending from an inner side of the outside rose liner, with each said positioning post having a screw hole; and two fasteners extending through the reinforcing ring and the inside rose liner into the screw holes of the positioning posts, thereby securing the reinforcing ring, the inside rose liner, and the outside rose liner together.

2. The lock as claimed in claim 1, with the respective tab of the reinforcing ring including an end piece having a width substantially equal to that of the respective groove of the inside seat.

3. The lock as claimed in claim 1, with the inside seat and the outside seat including aligned screw holes that are respectively aligned with the grooves of the inside seat, with two screws extending through the screw holes of the inside seat and the outside seat to thereby fix the inside seat and the outside seat together.

4. The lock as claimed in claim 1, with the reinforcing ring including two extensions projecting radially outward from an outer periphery of the reinforcing ring, with the respective extension having at least one hole, with the inside rose liner including at least one pair of through-holes, and with the respective fastener extending through said at least one hole of the respective extension and an associated one of said at least one pair of through-holes of the inside rose liner into the screw hole of the respective positioning post.

5. The lock as claimed in claim 1, with the outside seat including an outer threading, with an outside rose liner being threadedly engaged with the outer threading of the outside seat, allowing adjustment of a position of the outside rose liner along the longitudinal axis of the main body relative to the outside seat.

* * * * *